United States Patent [19]

Meindl

[11] Patent Number: 4,769,625

[45] Date of Patent: Sep. 6, 1988

[54] ELECTRICAL COIL WITH TERMINAL PINS IN ADAPTER PLATE

[75] Inventor: Gerhard Meindl, Alling, Fed. Rep. of Germany

[73] Assignee: Siemens Aktiengesellschaft, Berlin and Munich, Fed. Rep. of Germany

[21] Appl. No.: 120,243

[22] Filed: Nov. 12, 1987

Related U.S. Application Data

[63] Continuation of Ser. No. 869,369, Jun. 2, 1986, abandoned.

[30] Foreign Application Priority Data

Aug. 22, 1985 [DE] Fed. Rep. of Germany ..... 3530094

[51] Int. Cl.[4] ..... H01F 15/02; H01F 15/10

[52] U.S. Cl. ..... 336/65; 336/83; 336/192; 439/683

[58] Field of Search ..... 439/683, 350, 357; 336/65, 83, 192

[56] References Cited

U.S. PATENT DOCUMENTS

| | | | |
|---|---|---|---|
| 1,628,569 | 5/1927 | Worthington | 336/192 X |
| 2,343,675 | 3/1944 | Kenyon | 336/65 |
| 3,223,951 | 12/1965 | Antalek | 336/65 X |
| 3,434,088 | 3/1969 | Zieles | 336/192 |
| 3,543,220 | 11/1970 | Jones | 339/193 VS |
| 3,859,614 | 1/1975 | Reithmaier | 336/83 |

FOREIGN PATENT DOCUMENTS 3324078 1/1985 Fed. Rep. of Germany .

OTHER PUBLICATIONS

8163 Siemens Bauteile Report, vol. 15, No. 3 (1977-06), pp. 91-95.

Siemens Aktiengesellschaft, "FERRITE", 1982/83, pp. 162-175.

*Primary Examiner*—Thomas J. Kozma

*Attorney, Agent, or Firm*—Hill, Van Santen, Steadman & Simpson

[57] ABSTRACT

An electrical coil has a coil body with at least one end flange with wire guidance slots. Shell core halves are slipped onto the coil body and have guidance slots. A terminal carrier is provided for printed circuit boards having solder connections and onto which the coil is placed. Ends of a winding on the coil body are soldered to the solder terminals. The end flange of the coil body is fashioned as an end plate which carries solder terminals and has passages for the sidewalls and for a center bleb or projection of the one shell core half. The terminal carrier is replaced by an adapter plate that can be plugged onto the end plate. This adapter plate has solder terminals arranged in a prescribed grid dimension on its printed circuit board side, the ends of these solder terminals which face away therefrom being soldered to the solder terminals of the end plate.

5 Claims, 3 Drawing Sheets

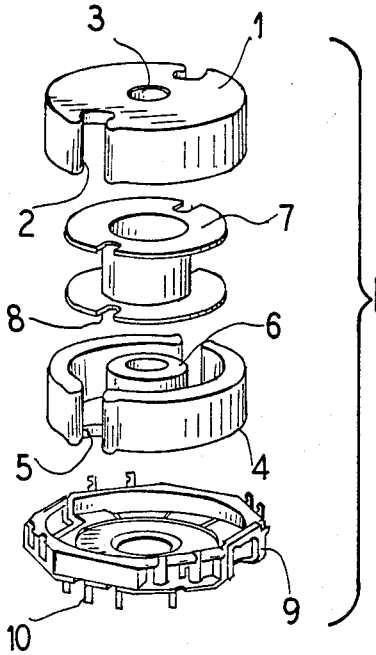
FIG. 1
(PRIOR ART)
FIG. 2 (PRIOR ART)
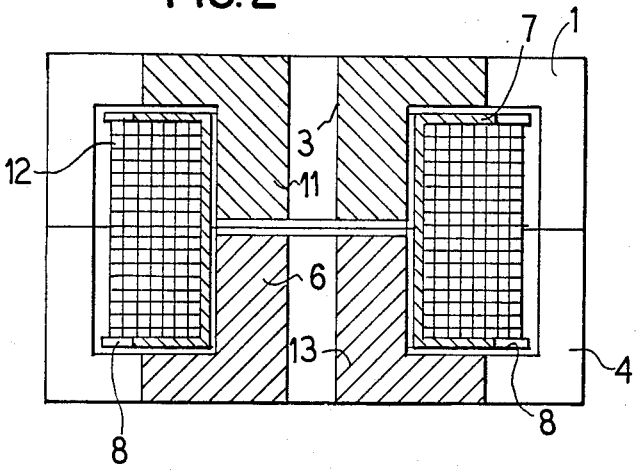

ELECTRICAL COIL WITH TERMINAL PINS IN ADAPTER PLATE

This is a continuation of application Ser. No. 869,369, filed June 2, 1986, now abandoned.

BACKGROUND OF THE INVENTION

The invention relates to an electrical coil comprising a coil body having end flanges with coil guidance slots. Shell core halves are slipped onto the coil body and have wire guidance slots. A terminal carrier for printed circuit boards has solder terminals 1 and receives the coil. Ends of the winding of the coil are soldered to the solder terminals.

An electrical coil of this type is described, for example, on page 163 of the data book "Ferrite-Weichmagnetisches SIFERRIT-Material", 1982/83 Edition, published by Siemens AG and incorporated herein, and is shown in a dismantled or cut view in FIGS. 1 and 2. Parts such as, for example, the balancing screw and the retaining strap which are not required for an understanding of the invention below are not shown.

This electrical coil comprises a coil body 7 wound with a winding 12 and having wire guidance slots 8. Shell core halves 1, 4, have wire guidance slots 2, 5, and are slipped onto the coil body 7. The shell core halves 1, 4 comprise center blebs 6, 11 or collar-shaped projections having cores 13 or 3 into which a balancing screw (not shown) dips. This balancing screw is screwed to a threaded sleeve (likewise not shown) that is guided in the projection bore 13.

The overall arrangement is placed onto a terminal carrier 9 which carries solder terminals 10 for the winding ends (not shown) of the winding 12.

As a result of its design, the assembly and the winding of this coil body of the electrical coil is largely possible only in a manual fashion.

SUMMARY OF THE INVENTION

An object of the present invention is to design this electrical coil such that the winding and the assembly thereof are possible on the basis of largely automated methods.

In order to achieve this object in an electrical coil, the invention provides that one of the end flanges of the coil body is designed as an end plate which carries terminal elements, ends of which form solder terminals and has passages for the sidewalls and for the middle projection or bleb of the one shell core half. The terminal carrier is replaced by an adapter plate that can be put in place on this end plate. This adapter plate has solder terminals on its printed circuit board side which are arranged in a prescribed grid dimension, and which have their ends facing away therefrom soldered to the solder terminals of the end plate.

With the invention, for automatic winding of the coil body, the coil body flange, not having any terminal elements, is replaced by an end plate having terminal elements forming solder terminals. The winding ends of the winding are wrapped directly on these solder terminals by the automatic winding unit. Errors in the terminal occupation, such as occur over and over again given manual winding, are no longer possible here.

As a result of its special design wherein the solder terminals of the terminals elements are displaced into the corner regions of the plate, the end plate equipped with passages for the sidewalls of the shell core and for the center bleb or projection of the shell core keeps the mounting surface for the shell cores free. As a result of the adapter plate fashioned with terminal elements, these electrical coils can be adapted to any arbitrary grid arrangement of a printed circuit board. The adapter plate also permits a use in coils which have already had their dimensions defined. This is enabled without modifying the winding rule and the grid arrangements on printed circuit boards.

The end plate and the adapter plate terminal elements can comprise terminal pins, ends of which elements solder terminals. Those ends of the terminal pins of the adapter plate which face away from the printed circuit board side are guided out of the adapter plate to the terminal pins of the end plate.

BRIEF DESCRIPTION OF THE DRAWINGS

FIG. 1 is a perspective view of a coil body with enclosing half shells and a terminal carrier according to the prior art;

FIG. 2 is a cross-sectional view of the assembled coil body with half shells according to the prior art assembly of FIG. 1;

DESCRIPTION OF THE PREFERRED EMBODIMENTS

Figure 3:
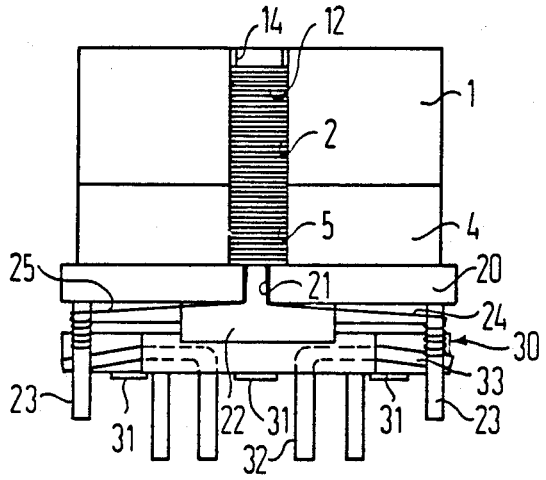
FIG. 3 is a side view of an electrical coil of the invention.
Figure 4:
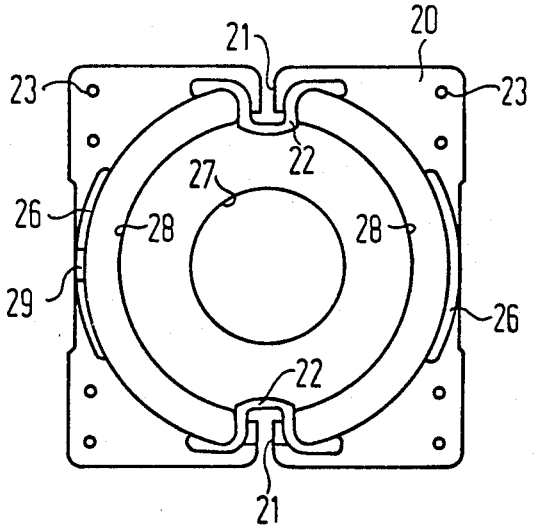
FIG. 4 is a bottom view of an end plate of the invention.

The electrical coil of FIG. 3 has ferrite shell core halves 1, 4 having wire guidance slots 2, 5, said halves being slipped onto a coil body. The coil body comprises an annularly shaped end flange having a centering element 14 which dips into the wire guidance slot 2 of the shell core half 1. At the end face at the opposite side, the coil body wound with a winding 12 carries an end plate 20 (shown in FIG. 4) as an end flange. In its corner regions, this rectangular end plate has terminal elements in the form of solder terminal pins 23 on which the winding ends 24, 25 of the winding 12 are wrapped. These winding ends are guided out through the wire guidance slots 5 of the shell core half 4 and through the wire guidance slots 21 of the end plate 20. The end plate 20 is equipped with passages 27 or 28 for the passage of the shell core walls of the shell core half 4 and of its center or projection.

Figure 5:
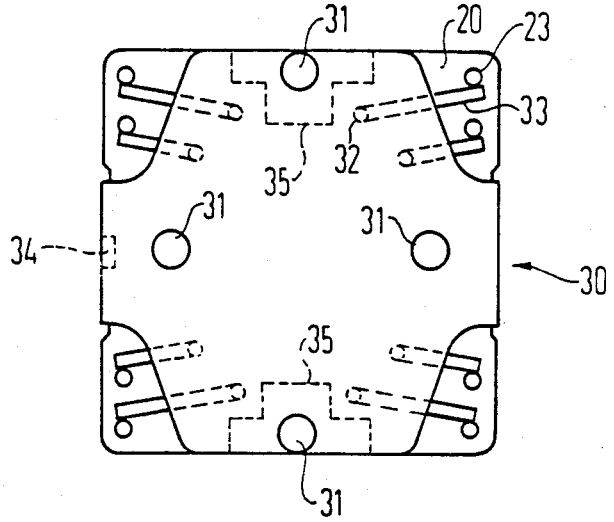
FIG. 5 shows a bottom view of the end plate of FIG. 4 with the adapter plate of the invention in place.

Reference numeral 30 in FIGS. 3 and 5 indicates an adapter plate which, for the purpose of being mounted on a printed circuit board (not shown here), comprises spacers 31 and solder terminal pins 32 arranged in the grid dimension. In its assembled condition, regions of the adapter plate 30 lie on seats 22, 26 of the end plate 20. The adapter plate 30 has extension or let-down portions 34, 35 acting as catch elements (indicated with dot-dash lines) engaging into peg-like catch elements 29 or into the seats 22, which are additionally fashioned as catch elements.

Those ends 33 of the solder terminal pins 32 of the adapter plate 30 which face away from the printed circuit board side are guided to the terminal pins 23 of the end plate 20 and are soldered thereto, for example by means of flow soldering.

Although various minor changes and modifications might be proposed by those skilled in the art, it will be understood that I wish to include within the claims of the patent warranted hereon all such changes and modifications as reasonably come within my contribution to the art.

I claim as my invention:

1. An electrical coil, comprising:

a coil body with at least one end flange having at least one wire guidance slot;

two shell core halves around said coil body and each having at least one wire guidance slot;

said at least one end flange of said coil body being an end plate carrying solder terminal elements arranged in a given pattern and having passage means for receiving side walls and a center projection of a lower one of the two shell core halves, wire winding ends of the coil being soldered to the solder terminal elements; and an adapter plate receiving said end plate, said adapter plate also having solder terminal elements whose first ends project from and are arranged at a printed circuit board side of the adapter plate in a desired pattern different than said given pattern, and opposite second ends of said adapter plate solder terminal elements being freely bent such that they are guided out of said adapter plate to a position directly adjacent to, abutting with, and electrically connected by solder to respective ones of the solder terminal elements of said end plate.

2. An electrical coil according to claim 1 wherein the solder terminal elements of said end plate and said adapter plate comprise terminal pins, second ends of said terminal pins of said adapter plate facing away from the printed circuit board being arranged adjacent said terminal pins of said end plate, and opposite first ends of said terminal pins of said adapter plate being arranged in said desired pattern.

3. An electrical coil body, comprising:

a coil body with an end flange;

a shell around said coil body for enclosing the same;

a coil body end flange comprising an end plate having solder terminal pins projecting away from the coil body, and wire ends of a coil wound on the coil body being soldered to the terminal pins in the end plate, said terminal pins of said end plate being arranged in a given location pattern;

an adapter plate mounted to said end plate and having terminal pins having first end means extending from a mounting side of said adapter plate for soldering or plugging to or in a printed circuit board, said first end means being arranged in a desired pattern different than said given pattern, and at least some of said terminal pins being freely bent such that second ends thereof are guided out from the adapter plate into abutting contact with the terminal pins of said coil body end flange where they are electrically connected to the terminal pins.

4. An electrical coil body according to claim 3 wherein said shell around said coil body comprises two shell core halves and wherein said end flange of said coil body has passage means for receiving side walls of a lower one of the two shell core halves.

5. An electrical coil body according to claim 3 wherein the second ends of the adapter plate terminal pins are electrically connected to the coil body end flange terminal pins by solder.

* * * * *